United States Patent [19]

Eitel

[11] 3,969,159

[45] July 13, 1976

[54] CASTING POWDER

[76] Inventor: Heinz-Joachim Eitel, Lonsweg 58, 433 Mulheim, Germany

[22] Filed: Sept. 3, 1974

[21] Appl. No.: 502,797

[30] Foreign Application Priority Data

Sept. 6, 1973 Germany ..... 2344840

[52] U.S. Cl. ..... 148/26; 75/94

[51] Int. Cl.[2] ..... B23K 35/34; C22B 9/10

[58] Field of Search ..... 75/94; 148/26

[56] References Cited

UNITED STATES PATENTS 2,748,040 5/1956 Conn ..... 148/26

2,755,211 7/1956 Jackson ..... 148/26

*Primary Examiner*—Peter D. Rosenberg

*Attorney, Agent, or Firm*—Karl F. Ross; Herbert Dubno

[57] ABSTRACT

A casting powder having a fluxing agent free from fluorides and borates and containing titanium dioxide in alloyed form or in admixture, preferably in an amount of 20 to 35 percent by weight.

9 Claims, No Drawings

CASTING POWDER

FIELD OF THE INVENTION

The present invention relates to a casting powder, especially for the casting of steel and preferably for high-alloy aluminum or titanium containing steel and for continuous casting comprising a fluxing agent in addition to the usual silicon dioxide, aluminum oxide, calcium oxide, magnesium oxide, sodium oxide, and potassium oxide or the carbonates thereof.

BACKGROUND OF THE INVENTION

Casting powders have been provided heretofore for the casting of steel, especially high-alloy steel (i.e. steel containing aluminum or titanium) and for continuous casting from silicon dioxide, aluminum oxide, calcium oxide, magnesium oxide, sodium oxide, potassium oxide and fluxing agents generally of the borate or fluoride type.

Casting powders of these kinds are used to increase the purity of the cast article, e.g. ingots or bars, blooms or the like, which are to be further worked, e.g. by rolling. They also improve the solidification characteristics of the cast materials and produce cast articles with especially fine surface properties. The casting powders with which the invention is concerned are not, however, confined to mold-lining powders for poured castings of the single-unit type but may be used for the casting of alloy steels, especially aluminum and titanium containing steels in such static molds as well as continuous-casting molds in which the product is a continuous ingot.

The casting powder used conventionally may contain a fluxing agent, hereinafter referred to generally as a flux, which contributes to improving the wetting characteristics of the slag formed during the process and reduces the melting point thereof, and modifies the viscosity.

In conventional systems the flux is a fluoride or borate, especially calcium floride (e.g. fluorspar) or sodium tetraborate decahydrate (borax). The use of fluorides and borates as fluxing agents in casting powder is not, however, free from disadvantages. For example, the use of fluorides as a fluxing agent in casting powders results in thermal decomposition of the fluxing agent to produce gaseous fluorine which is toxic and cannot be tolerated where environmental pollution is to be minimized. The use of borates as a fluxing agent may result in a cast article having a high concentration of boron in surface regions which modifies the structural characteristics of the cast article.

OBJECTS OF THE INVENTION

It is an object of the present invention to provide a casting powder which is free from the aforestated disadvantages, i.e. does not constitute an environmental pollutant and does not disadvantageously affect the article being cast.

Another object of the invention is to provide an improved casting powder for the purposes described.

SUMMARY OF THE INVENTION

The above and other objects of the invention have been realized with a casting powder which is free from fluorides and borates and consists predominantly of or contains titanium-oxide-containing materials or titanium oxide in alloyed form or admixtures. In other words, the casting powder according to the invention comprises, as a fluxing agent or flux, a titanium-dioxide-containing fluoride- and borate-free alloy or a titanium-dioxide-containing fluoride- and borate-free mixture. The system of the present invention has found that it is possible to exclude fluorides and borates as fluxing agents in casting powder when, instead of the usual fluorides and borates, titanium dioxide, titanium-dioxide-contaning alloys or titanium-dioxide-containing mixtures are employed.

The fluxing agent or flux according to the invention can be used in alloy form (i.e. comminuted from a melt into which titanium dioxide has been introduced) or in the form of a mixture of titanium dioxide with other substances known to be satisfactory in casting powders. The use of a milled or ground alloy has been found to be more satisfactory for casting technology than the use of a powder mixture containing titanium dioxide but it should be noted that the cost of manufacturing such alloys is substantially higher than that of the production of the mixture. Consequently, depending upon the application, one may choose to use the less expensive fluxing agent.

According to a feature of the invention the titanium dioxide, which can be present in a relatively wide range as a fluxing agent in the casting powder or present in the casting powder itself, is employed in an amount between 20 and 35 percent by weight of the fluxing agent. Best results are obtained where the titanium dioxide consists of 25 percent by weight to 32 percent by weight titanium dioxide. The other components of the fluxing agent can comprise silicon dioxide and/or sodium carbonate and/or potassium carbonate and/or calcium oxide. The fluxing agent may be added to the casting powder which can consist of silicon dioxide, aluminum oxide, calcium oxide, magnesium oxide, sodium oxide, potassium oxide in any proportion, i.e. the fluxing agent may consist entirely (100 percent) of the casting powder or may up any proportion thereof. Typically the casting powder can contain 10 to 90 percent and preferably 30 to 60 percent by weight of the casting powder when the latter includes the silicon dioxide, aluminum oxide, calcium oxide, magnesium oxide, sodium oxide, potassium oxide mentioned previously.

The particle size of the casting powder or fluxing agent may be any of the conventional particle sizes well known in the art.

SPECIFIC EXAMPLES

EXAMPLE I

A fluxing agent for casting powder is produced by intimately mixing and grinding together 32.0 percent by weight titanium dioxide, 24.9 percent by weight silicon dioxide and 43.1 percent by weight sodium carbonate. The resulting mixture is blended with conventional casting powder consisting of a mixture of equal parts of silicon dioxide, aluminum oxide, calcium oxide, magnesium oxide, sodium oxide and potassium oxide in such proportion that the titanium dioxide makes up at least 10 percent by weight of the total casting powder.

EXAMPLE II

An alloy is made by melting together 32.00 percent by weight titanium dioxide, 24.90 by weight silicon dioxide, 20.85 percent by weight sodium carbonate and 22.25 percent by weight potassium carbonate. The melt is cooled and permitted to solidify and is then broken up and finally ground to a particle size of the order of 10 to 300 microns. The resulting alloy is used directly as a casting powder or admixed in equal proportions with a casting powder as described in Example I.

EXAMPLE III 25.0 percent by weight titanium dioxide, 37.5 percent by weight silicon dioxide and 37.5 percent by weight calcium oxide are ground together and then melted to form an alloy which is broken up and used in a casting powder as described in Example II.

The casting powders of the above Examples were all employed for sandcasting of high-alloy steels containing titanium and aluminum as alloying ingredients with considerable success and without environmental pollution or detriment to the cast article. They were similarly used in the continuous casting of the same metals in a successful manner.

It should be noted that, while normally the casting powder will consist of two components, namely the usual casting powder components and the fluxing agent, the fluxing agent may make up 100% by weight of the casting powder, i.e. the substances produced in Example I through III above may be used directly as the casting powder without admixture with other components.

Since the casting powder in all cases is fluoride- and borate-free, gaseous fluorine is not evolved nor is there a contamination of the cast article with boron.

I claim:

1. A casting powder for steel casting consisting of a first casting powder component selected from the group which consists of silicon dioxide, aluminum oxide, calcium oxide, sodium carbonate, potassium carbonate, magnesium oxide, sodium oxide, and potassium oxide and a second casting powder component of titanium dioxide in a fluoride-free and borate-free composition.

2. The casting powder defined in claim 1 wherein said composition contains 20 to 35 percent by weight titanium dioxide.

3. The casting powder defined in claim 2 wherein said composition contains 25 percent by weight titanium dioxide.

4. The casting powder defined in claim 1 wherein said composition consists essentially of 32.0 percent by weight titanium dioxide, 24.9 percent by weight silicon dioxide, and 43.1 percent by weight sodium carbonate.

5. The casting powder defined in claim 1 wherein said composition consists essentially of 32.00 percent by weight titanium dioxide, 24.90 percent by weight silicon dioxide, 20.85 percent by weight sodium carbonate and 22.25 percent by weight potassium carbonate.

6. The casting powder defined in claim 1 wherein said composition consists of 25.0 percent by weight titanium dioxide, 37.5 percent by weight silicon dioxide and 37.5 percent by weight of calcium oxide.

7. The casting powder defined in claim 1 wherein said composition contains 32 percent by weight titanium oxide.

8. The casting powder defined in claim 1 wherein said composition is a mixture.

9. The casting powder defined in claim 1 wherein said composition is an alloy.

* * * * *